US008197391B2

(12) United States Patent
Ruschell

(10) Patent No.: US 8,197,391 B2
(45) Date of Patent: Jun. 12, 2012

(54) BALLET BARRE COVER

(76) Inventor: Rebecca S. Ruschell, Santa Monica, CA (US)

( * ) Notice: Subject to any disclaimer, the term of this patent is extended or adjusted under 35 U.S.C. 154(b) by 158 days.

(21) Appl. No.: 12/270,234

(22) Filed: Nov. 13, 2008

(65) Prior Publication Data

US 2010/0120586 A1 May 13, 2010

Related U.S. Application Data

(60) Provisional application No. 61/019,362, filed on Jan. 7, 2008.

(51) Int. Cl.
*A63B 21/00* (2006.01)

(52) U.S. Cl. ..... 482/41; 482/35

(58) Field of Classification Search ..... 482/105, 482/124, 35, 41, 148; 428/100; 206/315.3, 206/315.1; 150/154; 38/102, 91; 219/201; 211/124; 606/241; 5/147; 383/105
See application file for complete search history.

(56) References Cited

U.S. PATENT DOCUMENTS

| | | | | | |
|---|---|---|---|---|---|
| 21,143 | A * | 8/1858 | Davis | 202/265 |
| 2,052,606 | A * | 9/1936 | Comstock | 211/123 |
| 2,606,667 | A * | 8/1952 | Hornick | 211/124 |
| 2,984,486 | A * | 5/1961 | Jones | 473/568 |
| 3,217,137 | A * | 11/1965 | Weitzner | 219/201 |
| 3,456,807 | A * | 7/1969 | Amato | 211/123 |
| 3,831,941 | A * | 8/1974 | Pease | 267/116 |
| 3,874,375 | A * | 4/1975 | Penner | 606/241 |
| 3,958,801 | A * | 5/1976 | Correa | 482/41 |
| D312,371 | S * | 11/1990 | Lawson | D6/595 |
| 4,985,942 | A | 1/1991 | Shaw | |
| 5,378,522 | A | 1/1995 | Lagomarsino | |
| 5,561,927 | A * | 10/1996 | Blavat | 38/102.91 |
| 5,651,161 | A | 7/1997 | Asta | |
| 5,901,756 | A | 5/1999 | Goodrich | |
| 6,102,076 | A | 8/2000 | Romero, Jr. et al. | |
| 6,224,518 | B1 * | 5/2001 | Weiss et al. | 482/93 |
| 6,604,789 | B1 * | 8/2003 | Downing | 297/227 |
| 6,645,599 | B1 * | 11/2003 | Gabriele | 428/88 |
| 6,678,901 | B1 | 1/2004 | La Rossa | |
| 6,775,937 | B2 | 8/2004 | Ruana | |
| 6,786,256 | B2 * | 9/2004 | Sugawara | 150/158 |
| 2005/0204501 | A1 * | 9/2005 | Golec | 15/209.1 |
| 2007/0029535 | A1 | 2/2007 | Johnson | |
| 2008/0115250 | A1 * | 5/2008 | Tousant | 2/69 |
| 2008/0201882 | A1 * | 8/2008 | Hay et al. | 15/118 |
| 2008/0277359 | A1 * | 11/2008 | St. Martin | 211/16 |
| 2009/0220177 | A1 * | 9/2009 | Andreu | 383/105 |
| 2010/0089958 | A1 * | 4/2010 | Flagel et al. | 224/576 |

* cited by examiner

*Primary Examiner* — Jerome w Donnelly
(74) *Attorney, Agent, or Firm* — Greenberg Traurig LLP

(57) ABSTRACT

A cover for use with an elongated cylindrical ballet barre supported above a surface adapted to be gripped by the user comprising an elongated piece of a cushioning material encircling at least a portion of said barre and removably attached thereto.

7 Claims, 4 Drawing Sheets

BALLET BARRE COVER

RELATED APPLICATION

This application claims the benefit of and priority to U.S. Provisional Application Ser. No. 60/019,362, filed Jan. 7, 2008, the contents of which are incorporated by reference herein in its entirety.

BACKGROUND

1. Field

The disclosure is directed to ballet barres, and, more particularly, to a fabric covering tailored to fit around a ballet barre to protect the user's hands, feet, ankles and various parts of the body during ballet barre exercises.

2. General Background

A ballet barre is a handrail placed at approximately hip height, used by a dancer or ballerina, to maintain balance during practice. The dancer or ballerina sometimes holds on to the bar or barre with his or her hands, or contacts the bar or barre with one's feet, ankles, or various parts of the body during exercises and while stretching.

Conventional ballet barres are made of wood, such as poplar, oak or maple, finished or unfinished, or of metal, such as aluminum. The wood may be rough and result in splinters. The finishing may be glossy or varnished, stained, oiled, etc. Both types of barre material may cause calluses and are dirty and grungy. Such barres are usually cylindrical, varying in diameter from about 1¾ inches to 1⅞ inches, thus providing a circumference of about 5¾ inches.

There is thus a need for a cover for a ballet barre to protect the user's hands, feet, ankles, and various parts of the body while exercising or stretching. Such a cover should provide cushioning comfort to the user and protection while exercising at the ballet barre.

It is an object of this disclosure to provide a cover for a ballet barre that cushions the user's hands, feet and ankles while exercising. It is a further object of this disclosure to provide such a cover that is soft, absorbent, and machine washable.

It is still further an object of this disclosure to provide a fabric wrap or cover that goes around a ballet barre and comes in different lengths to accommodate different sized barres.

Another object of this disclosure is to provide such a cover that has quick and easy adjustable closures at each end and a center closure for the larger version.

These and other objects are accomplished by providing a cushioned cover for a conventional ballet barre that is an elongated cylinder, the cover encircling at least a portion of the barre. Optionally, a removable sweat towel may be removably attached to the cover, preferably centered over the barre so half of the towel hangs down each side thereof.

DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
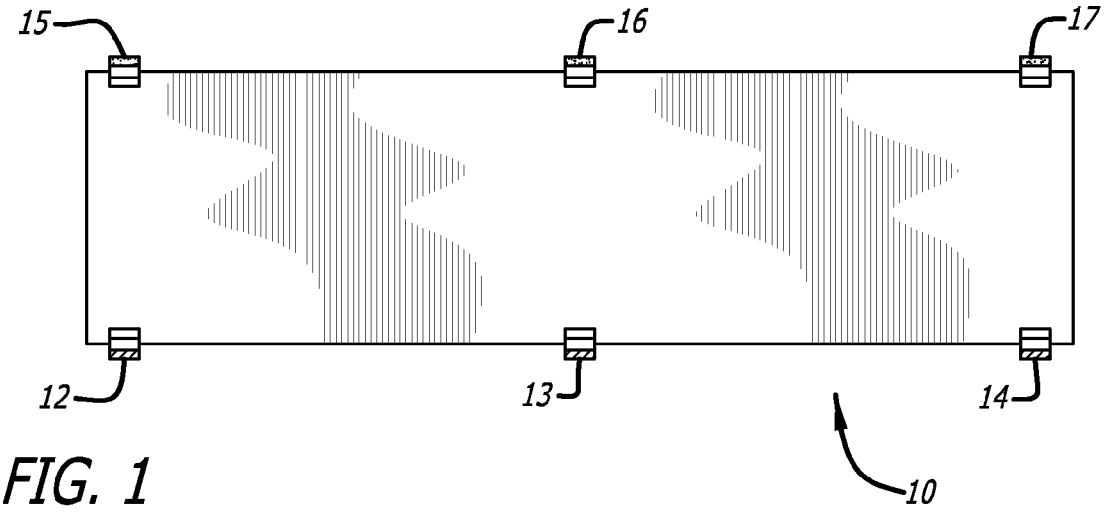
FIG. 1 is a top plan view of the underside of a "Grande" size cover for a ballet barre in accordance with the teachings of my disclosure.

Cover 10 in FIG. 1 is an elongated rectangular piece of fabric material, such as terry cloth, about one-quarter inch to one-half inch thick and about 5¾ inches wide with a length of 38 inches (these dimensions are preferred but may vary). The length of such barres varies greatly. For example, some barres may be at least 19 inches long and other barres may be at least 38 inches long, are cylindrical and about 5 inches to 5¾ inches in circumference. Cover 10 is of any suitable length and may be provided in two sizes for the user's preference.

That is, cover 10 in FIG. 1 may be the "Grande" size suitable for use on a ballet barre at least 38 inches long. If a ballet barre at least 19 inches long was provided, cover 11 in FIG. 2 would be used. This cover 11 may be 5¾ inches wide and 19 inches long and also one-quarter inch to one-half inch thick. The main difference between covers 10 and 11 is that cover 11 may have elastic strips of conventional hook and loop material at each corner and cover 10 in FIG. 1 may additionally have elastic strips and hook and loop strips at the middle.

Thus, cover 10 in FIG. 1 may have elastic strips 12 to 14 of loop material at each corner (12, 14) and middle (13) adapted to mate with elastic strips 15 to 17 at the corners (15, 17) and middle (16), of a hook material, adapted to mate with strips 12 to 14 (strips 15 and 12); strips 16 and 13 mate, and strips 17 and 14 mate.

Cover 11 is similarly provided with elastic strips of a mating hook and loop material at the four corners. That is, strips 18, 19 of loop material mate and removably attach to strips 20, 21, respectively, of hook material. It is to be understood that, in FIGS. 1 and 2, strips 15 to 17 and 20, 21 have the hook portions on the underside so that the strips can mate, as will be discussed.

Figure 2:
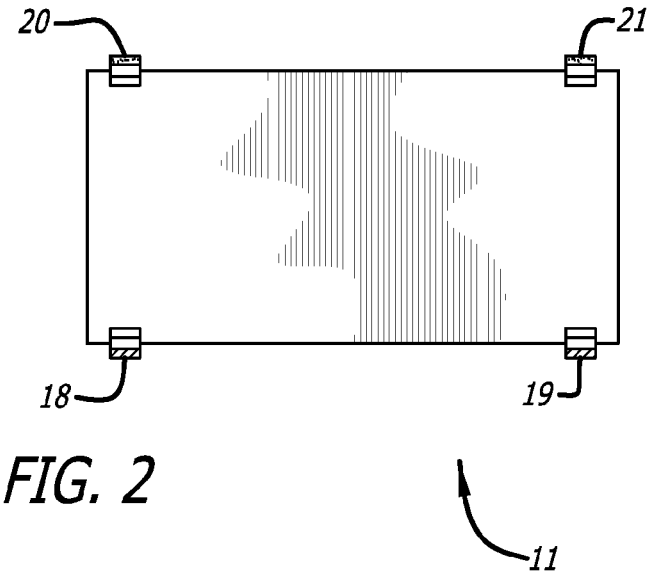
FIG. 2 is a top plan view of the underside of a "Demi" size cover for a ballet barre in accordance with the teachings of the disclosure.
Figure 3:
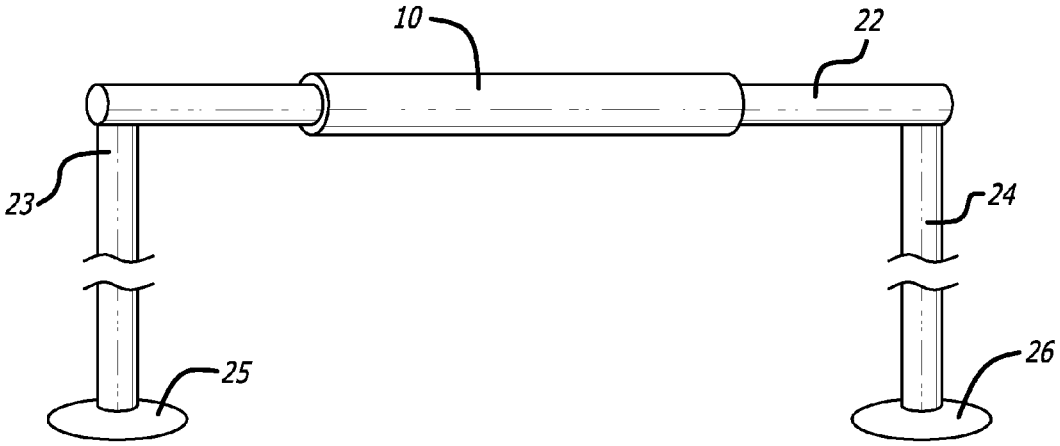
FIG. 3 is an elevational view of a conventional ballet barre having the cover of FIG. 1 installed thereon.

As seen in FIG. 3, cover 10 is wrapped around the conventional ballet barre 22 and tied thereto using fasteners 12 to 17 (FIG. 1). Of course, any suitable fasteners may be used. Cover 10 may be secured to barre 22 in any suitable manner, so that it may quickly be secured to barre 22, then removed therefrom. Although a Grande cover for barre 22 is shown in FIG. 3, the Demi cover 11 of FIG. 2 is applied to a like length barre in the same manner.

Normally, such barres are either wall mounted using fixed extension studs attaching the barre itself, or may be a portable, stand-alone variety with extension studs. For example, the posts 23, 24 in FIG. 3 support barre 22 at a height of about 6% inches from the floor, terminating in foot pads 25, 26, respectively.

Figure 4:
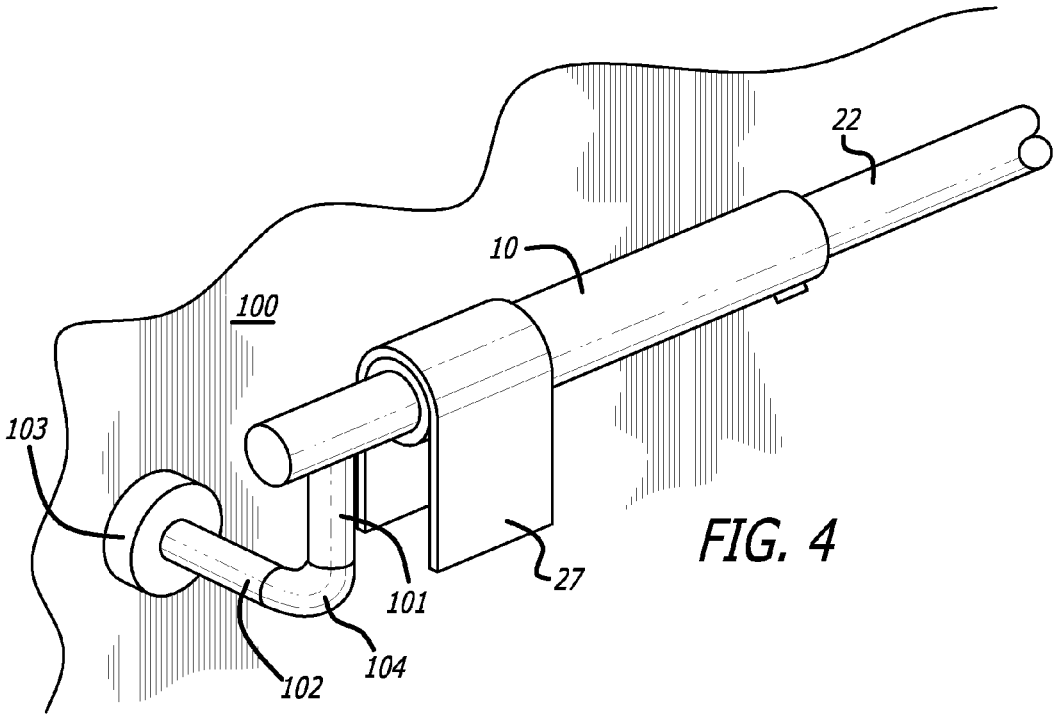
FIG. 4 is a plan view of an alternate mount for the barre of FIG. 3, showing a towel removably attached thereto.

Any suitable fabric material may be used that easily wraps around the barre and can be secured thereto using cording, snaps, ribbons, magnets, drawstrings, or elastic closures. Optionally, as shown in FIG. 4, a small sweat towel 27 may be provided, removably attached to cover 10. The cover 10 and/or towel 27 may be monogrammed and provided in different sizes. Instead of a floor mount, barre 22 may be mounted to wall 100 by rods 101 and 102, coupled together by elbow 140, connected to mount 103, fixed to wall 100.

Figure 5:
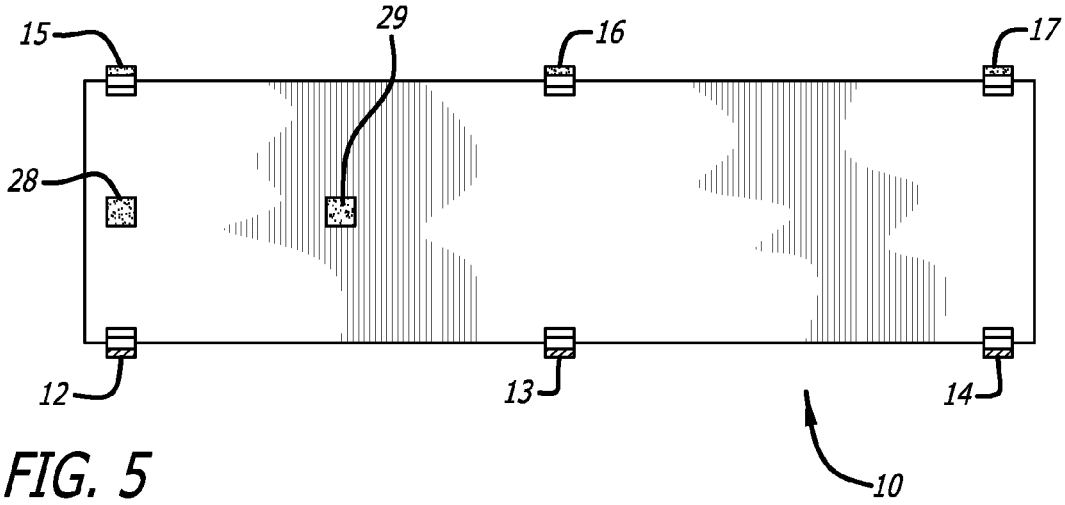
FIG. 5 is a view illustrating a modification of the cover of FIG. 1.
Figure 6:
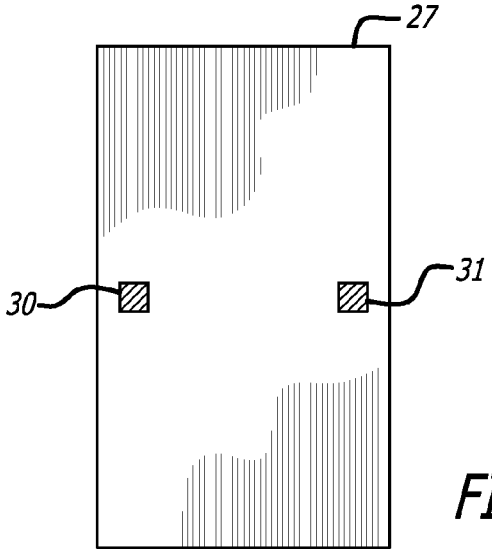
FIG. 6 is a plan view of a towel alone used with the covers of FIGS. 1 and 2.

Cover 10 is shown in FIG. 5, modified to receive towel 27, like numerals referring to like parts of FIG. 1. Thus, cover 10 and towel 27 may have matching hook and loop pieces, such as hook patches 28, 29, on cover 10 and loop patches 30, 31 on towel 27 (see FIG. 6) for attaching towel 27 to cover 10.

Figure 7:
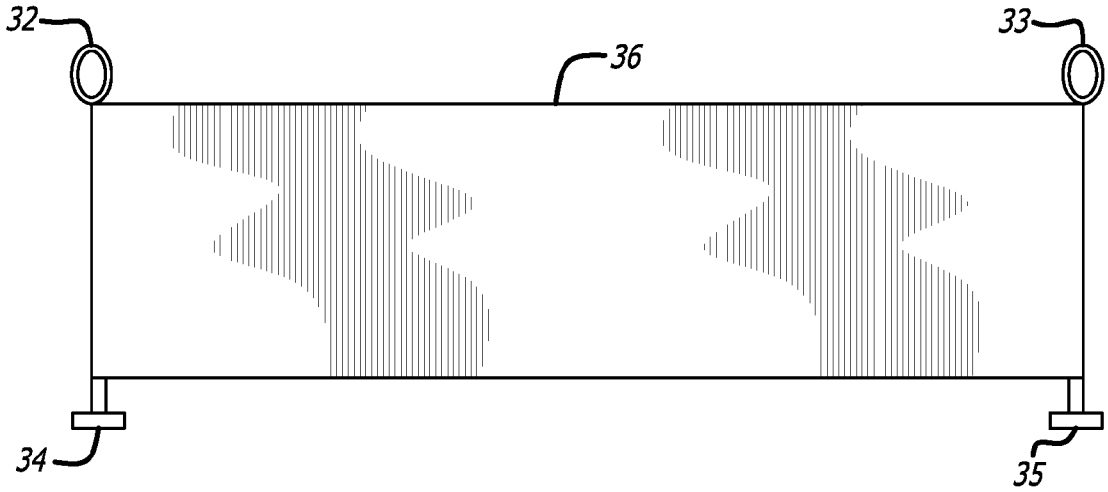
FIG. 7 is a plan view of the cover of FIG. 1 illustrating alternate attachment means.

The dimensions of covers 10 and 11 may vary. Towel 27 may be about 11 inches by 18 inches. Alternatively, for the fastening means, as seen in FIG. 7, cover 36 may have loops 32, 33, respectively, adapted to connect to connectors 34, 35, respectively.

The towel 27 and covers 10, 11 may be of any suitable fabric material, such as pile fabric, terrycloth, etc.

Thus, the ballet barre cover disclosed herein is used for comfort and protection while doing exercises at the ballet barre. It is a soft, absorbent, machine washable, fabric wrap or cover that goes around the ballet barre. It may come in two different lengths, Demi (19 inches) and Grande (38 inches). It may have quick and easy adjustable drawstring type closures at each end (and possibly snaps or other closures for the center of the "Grande" version only). A removable sweat towel (11 inches by 18 inches, the standard size of a fingertip towel) is attached on one side of the cover via hook and loop fasteners or the like. The sweat towel itself hangs centered—half of the towel hangs on one side of the barre and half hangs on the other.

The 38-inch "Grande" version, in addition to adding room, is meant especially for use when the dancer is facing away from the barre with both hands, behind his or her back, holding the barre. This way, during warm-up or other exercises which face away from the barre, the dancer is able to hold onto the barre cover with both hands. Thus, it can be used this way for warm-up and then possibly doubled over after such exercises to shorten it for other exercises.

The disclosure provides the following advantages to the user:

Added comfort and cushioning for hands, feet, ankles, and various parts of the body during ballet barre exercises and while stretching at the barre;

Helps prevent blisters, calluses, and chafing of the skin;

Helps prevent splinters from wooden barres;

Extra thickness discourages the bad habit of gripping the barre;

It is more sanitary (due to perspiration on hands; germs, skin diseases, infections, etc.);

Absorbs perspiration from the hands and prevents odors on aluminum and metal barres;

Establishes placement at the barre for class;

Eases and softens movement, sliding front and back (during port de bras, cambre, etc.);

Has a removable towel for perspiration, easily attached so it will not fall onto the floor (a falling towel poses a slipping risk);

Durability, machine washable;

To assign children's placement spots at the barre;

Security, comfort during difficult repetitive barre exercises; and

Fun, soft (personalized/monogrammed potentially) fabric choices;

Lengthens the life of the ballet barre itself by keeping it clean and sanitary. There is less wear and tear on the barres, providing an advantage to the studio owner.

May be used with a machine washable laundry bag for breathability and ease. Other ballet delicates may be tied to the barre whether or not the barre is in use.

Covers 10 and 11 may be reversible, such as cotton on one side, fleece on the other, providing optional surfaces. Covers 10 and 11 are of a soft, durable hygienic fabric device, may be of double thickness, and would revolutionize ballet classes. They quickly and easily slip around the ballet barre to provide much-needed extra padding and protection against blisters, splinters, calluses, chafing, and germs, and add a dash of style and fun to the conventional hard and often grimy ballet barre. They will fit around most standard barres and their fixed extension studs.

The material for covers 10 and 11 may be colored, as by dyeing, and of any suitable material, such as woven cotton, terry cloth, brushed cotton, microfiber, polyester ribbon, taffeta, twill, satin, damask, reverse twill, reverse satin, etc. Preferably, the material should be a soft fuzzy fabric with a super soft top. It should also be relatively durable and machine washable. Synthetic materials, or a combination thereof, may be used.

Cover may come in two sizes: Demi (19 inches by 5¾ inches) and Grande (38 inches by 5¾ inches). There is also a detachable perspiration towel that measures 11 inches by 18 inches. The cover may be made from two pieces of absorbent fabric sewn together for double-thickness and cushioning. It may be attached beneath the ballet barre via elastic and hook and loop closures for adjustability so as to fit each ballet barre.

The Grande cover may have three of the closures, one on each end and one in the middle. Thus, the Grande cover is thereby convertible to a Demi size cover by placing the end opposite the towel 27 under itself and attaching under the towel, under the barre. Then, the dancer secures the cover with the middle elastic hook and loop closure (which then becomes the end). This allows the dancer to convert the size—using the Grande size while facing away from the barre allows both hands to be behind the back simultaneously on the barre. Then, the dancer can convert the cover to a Demi size for using the barre traditionally with one hand on the barre.

The perspiration towel 27 (which may be woven cotton terrycloth, microfiber, etc.) for the cover is attached on the left hand side (when facing the barre) via small hook and loop closures—a hook on the cover and a loop on the towel 27.

Although a particular embodiment of the disclosure is disclosed, it is to be understood that other embodiments may be utilized and structural and functional changes may be made without departing from the scope of the present disclosure.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. The combination of a smooth surfaced ballet barre cylindrical in shape supported above a surface adapted to be gripped by the user, the improvement which comprises:

a smooth surfaced elongated ballet barre cylindrical in shape throughout its entire length supported above a surface;

an elongated cover of a cushioning material completely encircling said barre and removable therefrom, said cover having a first and second portion, said first portion being removably attached to said second portion, said cover being a rectangular parallelogram having four right angles, a pair of spaced elongated sides interconnected by a pair of spaced sides shorter than the elongated sides, said cover, when removed from said barre being about 19 to 38 inches in length and about 5 to 5¾ inches in width, said barre being 19 to 38 inches in length, and first securement means along one elongated side of said cover and second securement means along the other elongated side of said cover, said first securement means being secured to said second securement means when said cover completely encircles said barre, said cover having a front and back side and including a first pair of fasteners on one of said sides, a towel having a second pair of fasteners, said first pair of fasteners being removably secured to said second pair of fasteners on said towel so as to be removably secured to said cover.

2. The combination of claim 1, wherein said barre is about 1¾ inches to 1⅞ inches in diameter.

3. The combination of claim 1 wherein said cover is a rectangle about 19 to 38 inches in length by 5 to 5¾ inches in width and said towel is a rectangle about 11 inches by 18 inches.

4. The combination of claim 1 wherein said cover is of a soft, absorbent, machine washable fabric material.

5. The combination of a ballet barre cylindrical in shape supported above a surface adapted to be gripped by the user, the improvement which comprises:

a smooth surfaced elongated ballet barre cylindrical in shape throughout its entire length supported above a surface; and an elongated cover of a cushioning material completely encircling said barre and removable therefrom, said cover having a first and second portion, said first portion being removably attached, said rectangular cover having four corners, a first pair of fasteners at two of said corners along one elongated side thereof and a second pair of fasteners along the other elongated side thereof adapted to removably attach to said first pair of fasteners, said cover having a front and back side and including a first pair of fasteners on one of said sides, a towel having a second pair of fasteners, said first pair of fasteners being removably secured to said second pair of fasteners on said towel so as to be removably secured to said cover.

6. The combination of claim 5 wherein said cover is a rectangle about 19 to 38 inches in length by 5 to 5¾ inches in width and said towel is a rectangle about 11 inches by 18 inches.

7. The combination of a smooth surfaced ballet barre cylindrical in shape supported above a surface adapted to be gripped by the user, the improvement which comprises:

a smooth surfaced elongated ballet barre cylindrical in shape throughout its entire length supported above a surface;

an elongated cover of a cushioning material completely encircling said barre and removable therefrom, said cover having a first and second portion, said first portion being removably attached to said second portion, said cover being a rectangular parallelogram having four right angles, a pair of spaced elongated sides interconnected by a pair of spaced sides shorter than the elongated sides, said cover, when removed from said barre being about 19 to 38 inches in length and about 5 to 5¾ inches in width, said barre being 19 to 38 inches in length, and first securement means along one elongated side of said cover and second securement means along the other elongated side of said cover, said first securement means being secured to said second securement means when said cover completely encircles said barre, and a towel removably attached to said cover.

* * * * *